US007237879B2

(12) United States Patent
Langford et al.

(10) Patent No.: US 7,237,879 B2
(45) Date of Patent: Jul. 3, 2007

(54) METHOD AND APPARATUS FOR REDUCING NOZZLE FAILURE IN STORED INKJET PRINTHEADS

(75) Inventors: Jeffrey D Langford, Lebanon, OR (US); Donald L. Michael, Monmoth, OR (US); Harold F Mantooth, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 322 days.

(21) Appl. No.: 10/909,044

(22) Filed: Jul. 30, 2004

(65) Prior Publication Data

US 2006/0023036 A1 Feb. 2, 2006

(51) Int. Cl.
*B41J 2/17* (2006.01)
*B41J 2/15* (2006.01)

(52) U.S. Cl. ..... 347/84; 347/21

(58) Field of Classification Search ..... 347/84, 347/21

See application file for complete search history.

(56) References Cited

U.S. PATENT DOCUMENTS

| | | | | |
|---|---|---|---|---|
| 5,712,668 | A | 1/1998 | Osborne | |
| 5,847,728 | A | 12/1998 | Lee | |
| 5,946,009 | A | 8/1999 | Youn | |
| 5,953,024 | A | 9/1999 | Lee | |
| 6,050,680 | A * | 4/2000 | Moriyama et al. | 347/85 |
| 6,062,390 | A * | 5/2000 | Nakamura | 206/576 |
| 6,116,719 | A | 9/2000 | Maza | |
| 6,209,983 | B1 | 4/2001 | Osborne | |
| 6,332,481 | B1 * | 12/2001 | Shinada et al. | 141/18 |
| 6,497,471 | B1 | 12/2002 | Gargir | |
| 6,530,644 | B2 * | 3/2003 | Premnath et al. | 347/35 |
| 6,547,368 | B2 | 4/2003 | Silverbrook | |
| 6,572,213 | B2 * | 6/2003 | Valero | 347/19 |
| 6,663,220 | B2 * | 12/2003 | Suzuki et al. | 347/36 |
| 6,742,878 | B2 * | 6/2004 | Hara et al. | 347/86 |
| 6,886,930 | B2 * | 5/2005 | Hara et al. | 347/86 |
| 2001/0017642 | A1 * | 8/2001 | Shigemura | 347/85 |
| 2002/0070995 | A1 * | 6/2002 | Asaki et al. | 347/22 |
| 2002/0097292 | A1 * | 7/2002 | Saijo et al. | 347/30 |
| 2002/0191056 | A1 * | 12/2002 | Ardito | 347/86 |
| 2003/0007031 | A1 * | 1/2003 | Sugiyama | 347/33 |
| 2003/0222957 | A1 * | 12/2003 | Yuan | 347/86 |

FOREIGN PATENT DOCUMENTS

| | | |
|---|---|---|
| EP | 0 819 529 | 1/1998 |
| EP | 1 184 182 | 3/2002 |
| JP | 10244690 A * | 9/1998 |
| JP | 11 058776 | 3/1999 |

* cited by examiner

*Primary Examiner*—Stephen Meier
*Assistant Examiner*—Rene Garcia, Jr.

(57) ABSTRACT

An inkjet printhead and a method for increasing the shelf life thereof are herein disclosed. The inkjet printhead has one or more nozzles for dispensing a colorant. These nozzles are fluidically connected to a reservoir. A first colorant substantially fills the nozzles while a second colorant is reserved in the reservoir.

20 Claims, 2 Drawing Sheets

METHOD AND APPARATUS FOR REDUCING NOZZLE FAILURE IN STORED INKJET PRINTHEADS

TECHNICAL FIELD OF THE INVENTION

The present invention relates to a method and apparatus for reducing nozzle failure in printheads that have been stored or otherwise unused for extended periods.

BACKGROUND OF THE INVENTION

Most inkjet printers dispense colorants or inks that are comprised of a dye and/or a pigment that is either dissolved or suspended in a volatile solvent. When the print head of the printer deposits the colorants on a recording media such as paper or film, the solvents in the colorants quickly evaporate, leaving the dyes and/or pigments behind on the recording media.

During the manufacturing process printheads for inkjet printers must be tested. Accordingly, it is customary to provide an inkjet printhead with a dye and/or pigment based colorant that will be dispensed from the printhead as a test to ensure that the printhead functions properly. It may also be necessary to include a colorant with a printhead so that a printer in which the printhead is installed may be tested.

However, where colorants are allowed to remain in a printhead for extended periods of time, it is often the case that the volatile solvents that make up the colorants will at least partially evaporate, leaving within the nozzles of the print head a residue of particles or a precipitate. FIGS. 1*a*-1*c* illustrate how the evaporation of a volatile solvent from the colorant can result in the malfunction of the printhead.

FIG. 1*a* is a schematic view of a typical nozzle 12 in an inkjet printhead 10. As will be readily understood by those skilled in the art, a printhead 10 typically includes multiple nozzles 12, each of which is connected to a reservoir (not shown) by a conduit 14. Generally, a single conduit 14 will supply colorant 13 to multiple nozzles 12. In a thermal inkjet printhead, a small resistor 16 will be provided adjacent to the opening of the nozzle 12. The resistor 16 ejects colorant 13 from the nozzle 12 by rapidly raising the temperature of the colorant 13 so as to cause the solvent thereof to boil. The rapid expansion of the boiling solvent ejects a droplet (not shown) of colorant 13 from the opening of the nozzle 12 in a known manner. Other types of inkjet printheads may utilize a piezoelectric element in lieu of the resistor 16.

The printhead 10 illustrated in FIG. 1*a* represents a printhead that has been newly filled with the colorant 13. FIG. 1*b*, represents a printhead 10 that has been stored for a period of time. Over time the solvents present in the colorant 13 begin to evaporate as represented by arrows 18. The evaporation of the solvents from the colorant 13 concentrates the pigments and/or dyes present in the colorant 13. As more time passes, the pigments and/or dyes begin to form a solid accretion 2. As can be seen in FIG. 1*c*, the accretion 2 has grown to the point where it blocks the nozzle 12, thereby preventing its proper functioning.

In order to retard the evaporation of the solvents from a colorant, it is common to either cover the nozzles of a printhead with tape or else to ensure that the printhead is otherwise covered with a cap. While such methods do slow the evaporation of solvents from the colorant, simply covering a nozzle is not sufficient to prevent the formation of accretions in a nozzle where the printhead is placed in storage for an extended period of time. Accordingly, there is a recognized need for a method and/or and apparatus that will prevent the formation of accretions in the nozzles of the printhead, particularly where the printhead must be stored for extended periods of time either before it is used or between uses.

DETAILED DESCRIPTION

Figure 1A:
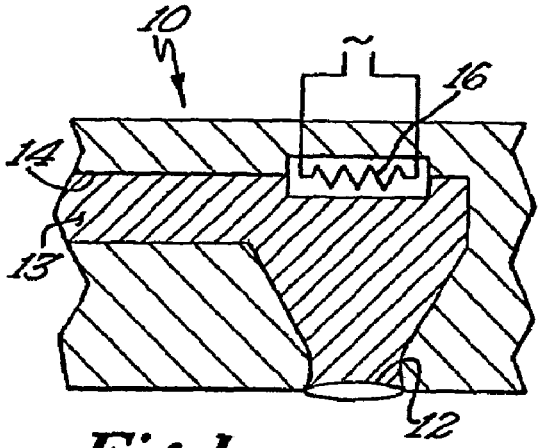
Fig 1a PRIOR ART
FIGS. 1*a*-1*c* are a schematic time-lapse depiction of a prior art printhead wherein solvents in a colorant evaporate to form an accretion in a nozzle.
Figure 1B:
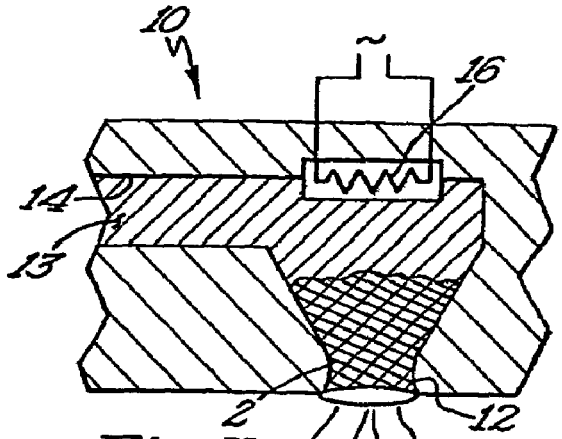
Fig 1b PRIOR ART
Figure 1C:
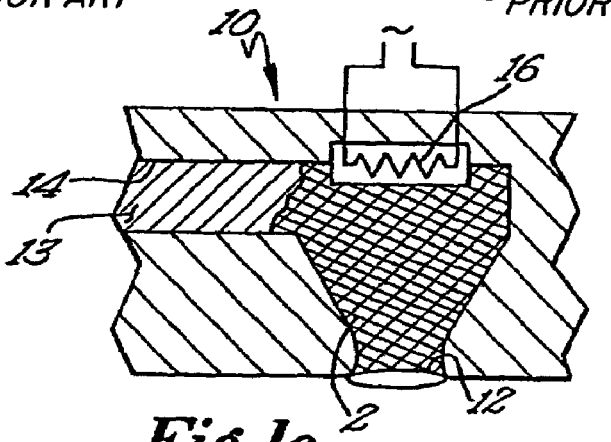
Fig 1c PRIOR ART

In the following detailed description, reference is made to the accompanying drawings that form a part hereof, and in which is shown, by way of illustration, exemplary embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

Figure 2:
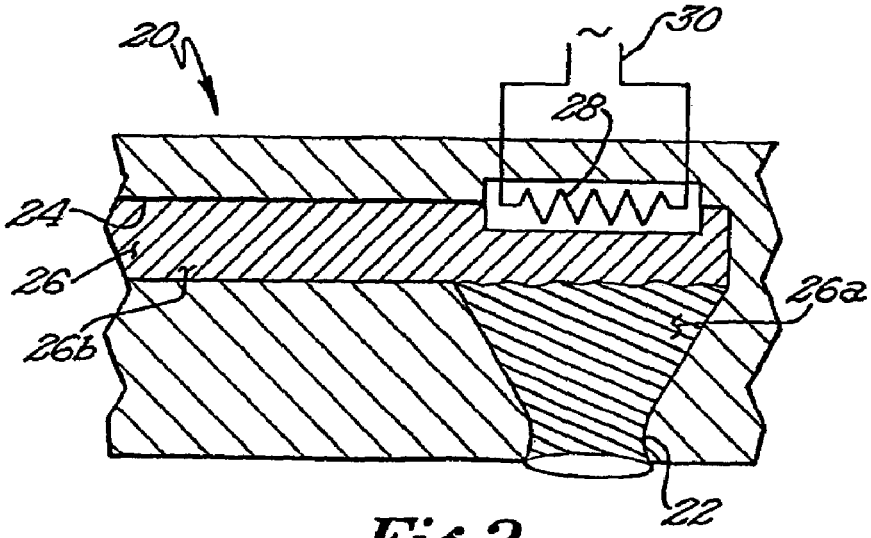
FIG. 2 is a schematic representation of an exemplary printhead having a low concentration colorant inserted into a nozzle according to the present invention.

FIG. 2 is a schematic representation of an exemplary printhead 20 having a single nozzle 22 formed therein. Note that in practice, inkjet printhead 20 would have multiple nozzles 22. However, for the sake of clarity, this description will demonstrate a printhead having only a single nozzle.

Colorants are supplied to the nozzle 22 through a conduit 24. The conduit 24 is fluidically connected to a reservoir (not shown) that provides a continuous supply of a colorant 26. While the exemplary methods and apparatuses herein may apply to any printhead or printing mechanism that utilizes a colorant 26 that comprises a volatile solvent, this description focuses on an exemplary thermal inkjet printhead embodiment. A resistor 28 is electrically connected to a controller via conductor 30. The controller (not shown) applies a current to the resistor 28, which boils the solvent in the colorant 26 immediately adjacent to the resistor 28. The boiling of the solvents creates a vapor bubble whose expansion ejects a droplet of the colorant 26 from the nozzle 22 so as to form an image on a recording media (not shown).

Because it may be necessary to test the printhead 20 after its manufacture, or test a printer (not shown) in which the printhead 20 has been installed, a first, dilute colorant 26*a* is inserted into the printhead 20 so as to substantially fill the nozzle 22. Note that the first colorant 26*a* must fill that portion of the nozzle 22 immediately adjacent to its opening. The first colorant 26*a* may also fill some portion of or the entire conduit 24 as well. Preferably, a second, more concentrated colorant 26*b* is placed in a reservoir 32 (see FIG. 3) and reserved separately therein. However, in certain applications, the second colorant 26*b* may be injected into the conduit 24 of the printhead 20 after the first colorant 26*a* has been inserted therein.

It has been found that the number of malfunctioning nozzles 22 present in a printhead 20 is directly related to both the concentration of the colorant 26 and to the length of time that the printhead 20 is in storage. Accordingly, the insertion of a first, more dilute colorant 26*a* directly into the nozzle 22 adjacent the opening thereof results in fewer malfunctioning nozzles 22 over a given period of time. Thus, as the solvents in the first colorant 26*a* will likely continue to evaporate, the lower concentration of dyes and/or pigments in the first colorant 26*a* results in the slower growth of accretions in the opening of the nozzle 22.

In certain embodiments, the first colorant 26*a* is simply a more dilute version of the more concentrated second colorant 26*b*. Once the printhead 20 has been manufactured, the first colorant 26*a* is inserted through the conduit 24 into the nozzle 22. The second colorant 26*b* is then injected into the reservoir 32. While the concentration of dyes and/or pigments in the first colorant 26*a* is lower than that of the second colorant 26*b*, the concentration is sufficient to allow the printhead 20 to be tested, as is commonly the practice, and yet yields fewer malfunctioning nozzles 22 after storage of the printhead 20 for a given period of time.

In certain other embodiments, the second colorant 26*b* is inserted into the printhead 20 at least part way into the conduit 24 but possibly also partly into the nozzle 22, keeping in mind that the first colorant 26*a* is to occupy the majority of the nozzle 22, and possibly all of the nozzle 22. Note that the dimensions of the conduit 24 in the nozzle 22 are such that the colorants 26*a* and 26*b* will not be significantly mixed together. Accordingly, it is possible for colorants 26*a* and 26*b*, differing only in their concentration is of dyes and/or pigments, to coexist side-by-side for extended periods of time without any significant mixing.

In some instances it may be preferable to utilize dissimilar colorants 26*a* and 26*b*. As used herein, the term "dissimilar" should be taken to include colorants 26 comprising different combinations and concentrations of solvents, and coloring agents such as dyes and/or pigments. By way of example only, in some instances it may be desirable to utilize a colorant 26*a* that has a different hue, or for that matter a completely different color, than the colorant 26*b*. To further prevent mixing of the colorants 26*a*, 26*b* it may be desirable to select solvents for the respective colorants that are dissimilar or even immiscible with one another. Alternatively, it may be desirable to select a solvent or mixture of solvents for use in the colorant 26*a* that have a relatively low volatility.

Figure 3:
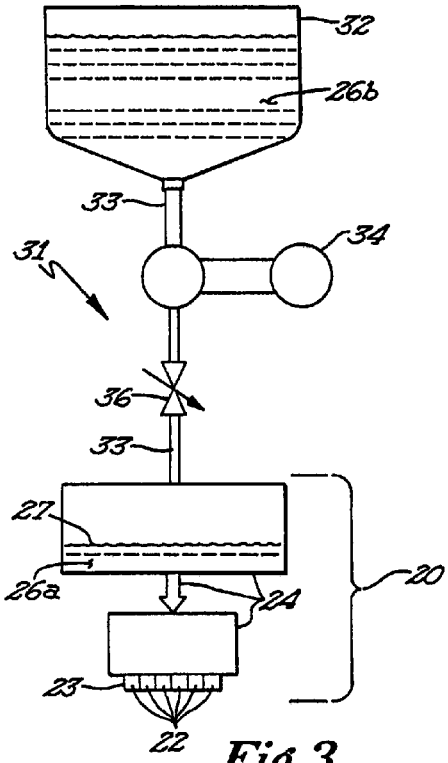
FIG. 3 is a schematic representation of an exemplary printhead and colorant supply system for operating a printhead such as that illustrated in FIG. 2; and, FIG. 4 is a schematic representation of an exemplary printhead such as that illustrated in FIG. 2 and further including an exemplary nozzle priming system.

FIG. 3 illustrates an apparatus for implementing the present invention. In this embodiment, nozzles 22 are formed in a nozzle orifice plate 23. Colorant is supplied to the nozzles 22 in the nozzle orifice plates 23 through a conduit 24. As can be seen in FIG. 3, the conduit 24 may be sized so as to include a modicum of storage place for colorants 26. The conduit 24 is fluidically connected to a colorant delivery system 31. The colorant delivery system 31 includes a colorant supply reservoir 32 that is connected to the conduit 24 by a line 33 that passes through a pump 34 and a valve 36. Note that in some embodiments the colorant delivery system 31 may be located remotely from the printhead 20. In other embodiments, the ink delivery system 31 may be formed as an integral part of the printhead 20. It is to be understood therefore that line 33 is to be construed to include any coupling mechanism for connecting the reservoir 32 to the conduit 24.

During normal operation, pump 34 is actuated to move colorant from the reservoir 32 through the line 33 into the conduit 24. The valve 36 may be operated to selectively open and close the line 33, thereby permitting or preventing, as the case may be, the flow of colorant from the reservoir 32 into the conduit 24. The colorant 26 flows through the conduit 20 either due to the force of gravity or as the pump 34 has pressurized the colorant 26 in the conduit 24.

As part of the manufacturing process, or as part of a "mothballing" procedure, the apparatus illustrated in FIG. 3 will have a predetermined quantity of the first colorant 26*a* inserted into the conduit 24 as represented by fill line 27. The amount of the first colorant 26*a* inserted into the conduit 24 is sufficient to allow one or more required tests of the printhead 20 and to ensure that the nozzles 22 remain substantially filled with the first colorant 26*a*. A port or other access point (not shown) may be provided in the printhead 20 so as to allow the injection of a quantity of the first colorant 26*a* into the conduit 24 at the time of manufacture or later, after the printhead 20 has been installed in a printer. Such port or other access point may then be closed in some manner.

In certain exemplary embodiments, multiple reservoirs 32 may be used. In the illustrated embodiment, the printhead 20 is prepared for printing an image on recording media by actuating the colorant delivery system 31 to withdraw the first colorant 26*a* from the printhead 20 and into a first reservoir 32. Once the first colorant 26*a* has been removed from the printhead 20, the reservoir 32 containing the first colorant 26*a* is uncoupled from the colorant delivery system 31 and a second reservoir 32, this one having the second colorant 26*b* contained therein, is coupled to the colorant delivery system 31. The colorant delivery system 31 is then actuated to provide the second colorant 26*b* to the printhead 20 for printing. The first colorant 26*a* may be conserved in the first reservoir 32 or may be discarded. Where it is desirable to "mothball" the printhead 20, the colorant delivery system 31 may be actuated to withdraw the second colorant 26*b* from the printhead 20 back into its reservoir 32 for conservation. Thereafter, the first colorant 26*a* may be reintroduced into the printhead 20 by coupling a reservoir 32 having the first colorant 26*a* contained therein to the colorant delivery system 31. The colorant delivery system 31 will then be actuated to reintroduce the first colorant 26*a* into the printhead 20.

The nozzles 22 of the printhead 20 may be closed as by capping or taping and as seems appropriate given the application to which the printhead 20 will be put. The printhead 20 may then be placed into storage or otherwise inactivated. Note that the printhead 20 may be detached from the line 33 and stored apart from the reservoir 32, pump 34 and valve 36, may be installed in a printer along with the reservoir 32, pump 34, and valve 36 for storage, or a combination of the reservoir 32, pump 34 and valve 36 may be stored together with the printhead 20 in an integral package. For the purposes of the present application, the term "storage" should be taken to mean the reservation of the printhead 20 at a location remote from a printer or an extended period of inactivity where the printhead 20 is installed in a printer. The second colorant 26*b* may be retained entirely within the reservoir 32, leaving only the first colorant 26*a* in the conduit 24. Alternatively, the second colorant 26*b* can be inserted into the conduit 24 behind and up to the first colorant 26*a* up to line 27 as shown in FIG. 3.

Where the printhead 20 is currently in use but is to undergo a period of prolonged in activity, a mothballing procedure may be performed upon the printhead 20. During such a procedure, relatively concentrated colorant 26*b* present in the conduit 24 and nozzles 22 is either ejected or is withdrawn into the reservoir 32 by means of the pumping action of the pump 34 through line 33. Thereafter, dilute colorant 26*a* may be inserted into the conduit 24 through the aforementioned port so as to substantially fill the nozzles 22. In an alternate embodiment, and as it is likely that some quantity of concentrated colorants 26*b* may be retained within the conduit 24 and nozzles 22, a compatible solvent not having a dye and/or pigments included therein may be inserted into the conduit 24 to be mixed with the second colorant 26*b* remaining in the conduit 24 by means of pulsing the pump 34 as described herein above. Alternatively, the pure solvents added to the conduit 24 may be drawn through the conduit 24 and expelled from the nozzles 22 by the normal operation of the nozzles 22, the nozzles 22 being operated so as to draw sufficient quantities of the pure solvents into the nozzles 22 to reduce the incidence of malfunction in the nozzles 22 when the printhead 20 is installed and/or reactivated.

Upon installation of the printhead 20 in a printer, or upon reactivation of the printhead 20 in a printer, printing of an image upon recording media may commence using the first colorant 26*a*. The use of a dilute mixture of the second colorant 26*b* as the first colorant 26*a* may allow the printhead 20 to begin printing in such a way as to produce images of an acceptable quality where the color, hue, and/or intensity of the first colorant 26*a* is near enough to satisfy the image quality requirements expected of images printed using the second colorant 26*b*. Alternatively, one or more test images or patterns may be printed for the express purpose of exhausting the supply of the first colorant 26*a* within the printhead 20 prior to the start of printing using the desired second colorant 26*b*.

The apparatus illustrated in FIG. 3 may also be operated in such a way as to mix the first and second colorants 26*a*, 26*b* prior to the start of printing by the printhead 20. In this embodiment, the first colorant 26*a* is a dilute version of the second colorant 26*b*. Upon installation of the printhead 20 in a printer, or upon reactivation of the printhead 20 after a period of inactivity, valve 36 is opened and pump 34 is operated so as to alternatively pump the second colorant 26*b* from the reservoir 32 into the conduit 24 and to withdraw the first colorant 26*a* from the conduit 24 into the reservoir 32, thereby effectively mixing the first and second colorants 26*a* and 26*b*. In order to ensure that the colorant 26 used to print an image on a recording media retains a desired color intensity, the second colorant 26*b* contained within the reservoir 32 may be highly concentrated or the reservoir 32 may be over-filled, the concentration and/or volume of the second colorant 26*b* being such that the addition of a quantity of the dilute first colorant 26*a* does not significantly affect desired colorant properties such as intensity, hue, or the like.

Figure 4:
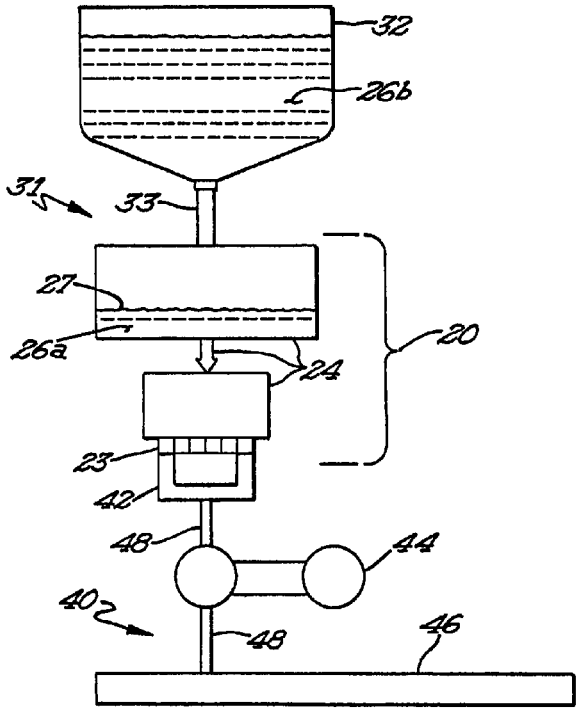

FIG. 4 illustrates another exemplary embodiment that includes a colorant delivery system 31, a printhead 20, and a nozzle priming system 40. As described above, the ink delivery system 31 includes a reservoir 32 that is fluidically coupled to the conduit 24 of the printhead 20 by means of line 33. While in the embodiment illustrated in FIG. 4, no pump or valve has been included in line 33, such may be added where warranted by the application under consideration. The nozzles 22 of the printhead 20 are included in the nozzle orifice plate 23. See FIG. 3. As illustrated, the printhead 20 is filled up to fill line 27 with a first colorant 26*a*. While FIG. 4 does illustrate that the conduit 24 is at least partially filled with the first colorant 26*a*, it must be kept in mind that all that is required is that the nozzles of the nozzle orifice plate 23 be partially or substantially filled with the dilute, first colorant 26*a*. The more concentrated second colorant 26*b* is contained within the reservoir 32 of the ink delivery system 31 and is supplied, upon demand, to the printhead 20 through line 33. The nozzle priming system 40 comprises a priming cap 42 that is constructed and arranged to fit snugly over the nozzle orifice plate 23, preferably forming a seal thereover. The priming cap 42 is connected through a pump 44 to a priming reservoir 46 by means of line 48.

In operation, the printhead 20 is first installed in a printer or is reactivated after a period of inactivity; pump 44 is actuated to draw the first colorant 26*a* from the nozzle orifice plate 23 and conduit 24 of the printhead 20 and into the priming cap 42. The first colorant 26*a* is then deposited into the priming reservoir 46. In this embodiment, once the first colorant 26*a* is removed from the printhead 20 and deposited in the priming reservoir 46, it will not be reused. It is to be understood however that the first colorant 26*a* may be reused where so desired.

As the first colorant 26*a* is drawn from the printhead 20, the action of the pump 44 will simultaneously draw the second colorant 26*b* from the reservoir 32 into the condiut 24 and subsequently into the nozzles of the nozzle orifice plate 23. At this point, the printhead 20 is ready to begin printing an image using the second colorant 26*b*.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A method of improving shelf life in a printhead that uses a volatile colorant comprising:

providing a printhead having at least one nozzle for dispensing the volatile colorant therefrom, the at least one nozzle being fluidically connected to a reservoir for storing and dispensing the volatile colorant to the at least one nozzle;

introducing a first colorant to the printhead, the first colorant substantially filling the at least one nozzle;

reserving a second colorant in the reservoir; and alternately drawing the first colorant from the printhead into the reservoir and drawing the second colorant from the reservoir into the printhead to substantially mix the first and the second colorants.

2. The method of improving shelf life in a print head that uses a volatile colorant of claim 1 further comprising the step of printing with the mixed first and the second colorants.

3. The method of improving shelf life in a print head that uses a volatile colorant of claim 1 further comprising the step of:

storing the printhead in a package prior to installing the printhead in a printer.

4. The method of improving shelf life in a printhead that uses a volatile colorant of claim 1 wherein:

introducing a first colorant to the printhead further comprises introducing a first colorant having coloring agent and solvent to the printhead; and reserving a second colorant in the reservoir further comprises reserving a second colorant having coloring agent and solvent in the reservoir, the second colorant having a higher concentration of coloring agent than the first colorant.

5. The method of improving shelf life in a print head that uses a volatile colorant of claim 4 wherein reserving a second colorant having coloring agent and solvent in the reservoir further comprises reserving a second colorant having coloring agent that is the same as the coloring agent of the first colorant and solvent in the reservoir.

6. The method of improving shelf life in a print head that uses a volatile colorant of claim 4 wherein reserving a second colorant having coloring agent and solvent in the reservoir further comprises reserving a second colorant having coloring agent of the same color as the coloring agent of the first colorant and solvent in the reservoir.

7. The method of improving shelf life in a print head that uses a volatile colorant of claim 1 wherein:

introducing a first colorant to the printhead further comprises introducing a first colorant having coloring agent selected from a group consisting of a dye and a pigment to the printhead; and reserving a second colorant in the reservoir further comprises reserving a second colorant having coloring agent selected from a group consisting of a dye and a pigment in the reservoir.

8. The method of improving shelf life in a print head that uses a volatile colorant of claim 1 wherein:

introducing a first colorant to the printhead further comprises introducing a first colorant having coloring agent and solvent to the printhead; and reserving a second colorant in the reservoir further comprises reserving a second colorant having coloring agent and the same solvent as first colorant in the reservoir.

9. The method of improving shelf life in a print head that uses a volatile colorant of claim 1, wherein alternately drawing the first colorant from the printhead into the reservoir and drawing the second colorant from the reservoir into the printhead to substantially mix the first and the second colorants is performed upon installation of the printhead in a printer.

10. A method of improving shelf life in a printhead that uses a volatile colorant comprising:

providing a printhead having at least one nozzle for dispensing colorant therefrom, the at least one nozzle being fluidically connected to a reservoir for storing and dispensing colorant to the at least one nozzle;

introducing a first colorant to the printhead, the first colorant substantially filling the at least one nozzle;

reserving a second colorant in the reservoir;

providing a colorant supply system that fluidically connects the reservoir and the printhead, the colorant supply system comprising a pump and a valve connected in line between the printhead and the reservoir;

actuating the colorant supply system to mix the first and the second colorants prior to activating the printhead for printing; and alternately drawing the first colorant from the printhead into the reservoir and drawing the second colorant from the reservoir into the printhead to substantially mix the first and the second colorants.

11. A printing mechanism comprising:

a printhead having at least one nozzle for dispensing a colorant therefrom;

a reservoir for storing and dispensing colorant to the at least one nozzle, the at least one nozzle being fluidically connected to the reservoir;

a first colorant disposed in the printhead, the first colorant substantially filling the at least one nozzle;

a second colorant disposed in the reservoir; and a pump and a valve, the pump and the valve being fluidically connected in line between the reservoir and the printhead, the pump and the valve being constructed and arranged to effect the mixing of the first colorant and the second colorant;

wherein the pump and the valve are constructed and arranged to alternately draw the first colorant from the printhead into the reservoir and draw the second colorant from the reservoir into the printhead, the alternate motion of the first and second colorants effectively mixing the first and second colorants.

12. The printing mechanism of claim 11 further comprising:

a nozzle priming cap constructed and arranged to fit over the at least one nozzle of the printhead, the nozzle priming cap forming at least a partial seal around the at least one nozzle;

a second pump fluidically connected to the nozzle priming cap, the pump being constructed and arranged to apply a vacuum to the at least one nozzle through the nozzle priming cap; and a priming reservoir fluidically connected to the nozzle priming cap.

13. The printing mechanism of claim 11 wherein the printhead further comprises a port for injecting therein to a quantity of the first colorant, the quantity of the first colorant being sufficient to substantially fill the at least one nozzle.

14. A method of constructing a printing system, comprising:

providing a printhead having at least one nozzle for dispensing colorant therefrom, the at least one nozzle being fluidically connected to a reservoir for storing and dispensing colorant to the at least one nozzle;

introducing a first colorant to the printhead, the first colorant substantially filling the at least one nozzle;

reserving a second colorant in the reservoir so that the second colorant is separate from the first colorant;

fluidically connecting a pump and a valve in line between the reservoir and the printhead; and configuring the printing system so that the pump and the valve alternately draw the first colorant from the printhead into the reservoir and draw the second colorant from the reservoir into the printhead, the cooperation of the pump and valve being such as to substantially mix the first and the second colorants.

15. The method of claim 14 wherein the first and second colorants comprise a coloring agent and a solvent, the second colorant having a higher concentration of coloring agent than the first colorant.

16. The method of claim 15 wherein the coloring agent is selected from a group consisting of a dye and a pigment.

17. The method of claim 15 wherein the solvents of the first and second colorants are the same.

18. The method of claim 15 wherein the coloring agents of the first and second colorants are the same.

19. The method of claim 14 further comprising:

providing a priming system for withdrawing the first colorant from the printhead, the priming system comprising:

a nozzle priming cap constructed and arranged to fit over the at least one nozzle of the printhead, the nozzle priming cap forming at least a partial seal around the at least one nozzle;

a pump fluidically connected to the nozzle priming cap, the pump being constructed and arranged to apply a vacuum to the at least one nozzle through the nozzle priming cap; and a priming reservoir fluidically connected to the nozzle priming cap.

20. The method of claim 14 further comprising:

providing the printhead with a port for injecting therein to a quantity of the first colorant, the quantity of the first colorant being sufficient to substantially fill the at least one nozzle.

* * * * *

UNITED STATES PATENT AND TRADEMARK OFFICE

CERTIFICATE OF CORRECTION

PATENT NO. : 7,237,879 B2
APPLICATION NO. : 10/909044
DATED : July 3, 2007
INVENTOR(S) : Jeffrey D. Langford et al.

It is certified that error appears in the above-identified patent and that said Letters Patent is hereby corrected as shown below:

On the Title page, in Item (75), in "Inventors", in column 1, line 2, delete "Monmoth" and insert -- Monmouth --, therefor.

Signed and Sealed this

Seventh Day of October, 2008

JON W. DUDAS
*Director of the United States Patent and Trademark Office*